US005496003A

United States Patent [19]

Bernard

[11] Patent Number: 5,496,003

[45] Date of Patent: Mar. 5, 1996

[54] SYSTEM FOR TRANSMISSION OF INFORMATION BETWEEN THE GROUND AND MOVING OBJECTS, IN PARTICULAR IN GROUND-TRAIN COMMUNICATIONS

[75] Inventor: Patrice H. Bernard, Paris, France

[73] Assignee: Societe Nationale des Chemins de fer Francais, Paris, France

[21] Appl. No.: 137,066

[22] PCT Filed: Apr. 23, 1992

[86] PCT No.: PCT/FR92/00364

§ 371 Date: Dec. 15, 1993

§ 102(e) Date: Dec. 15, 1993

[87] PCT Pub. No.: WO92/19483

PCT Pub. Date: Nov. 12, 1992

[30] Foreign Application Priority Data

Apr. 24, 1991 [FR] France ..... 91 05045

[51] Int. Cl.[6] ..... B61L 3/00

[52] U.S. Cl. ..... 246/29 R; 246/8; 246/63 C

[58] Field of Search ..... 246/7, 8, 3, 29 R, 246/28 C, 63 R, DIG. 1, 63 C; 342/44; 455/55.1; 343/770

[56] References Cited

U.S. PATENT DOCUMENTS

| | | | |
|---|---|---|---|
| 2,393,291 | 1/1946 | Clark | 246/8 |
| 3,281,591 | 10/1966 | Takeya | 246/8 |
| 3,617,890 | 11/1971 | Kurauchi | 246/8 |
| 3,629,707 | 12/1971 | Baba | 246/8 |
| 3,694,751 | 9/1972 | Takahashi et al. | 246/8 |
| 3,781,687 | 12/1973 | Nakahara et al. | 246/8 |
| 4,910,793 | 3/1990 | Mainardi | 246/7 |
| 4,932,617 | 6/1990 | Heddebaut et al. | 246/8 |

FOREIGN PATENT DOCUMENTS

| | | | |
|---|---|---|---|
| 0252199 | 1/1988 | European Pat. Off. | 246/7 |
| 2626834 | 8/1989 | France . | |
| 0021640 | 2/1985 | Japan | 246/8 |

*Primary Examiner*—Mark T. Le
*Attorney, Agent, or Firm*—Sughrue, Mion, Zinn, Macpeak & Seas

[57] ABSTRACT

A system for transmitting data between the ground and moving vehicles, for example consisting of a stretch of railway line $V_1$ having beacons between the rails. The various beacons are connected to nodes, e.g. $N_i$, $N_j$, $N_k$, which are in turn linked to a nodal transmission point (CNT) and to fixed railway installations controlling, for example, a points motor. The system is useful particularly in the field of data transmission between the ground and moving railway vehicles such as locomotives, passenger coaches, freight wagons, and train units.

13 Claims, 5 Drawing Sheets

Figure 1:
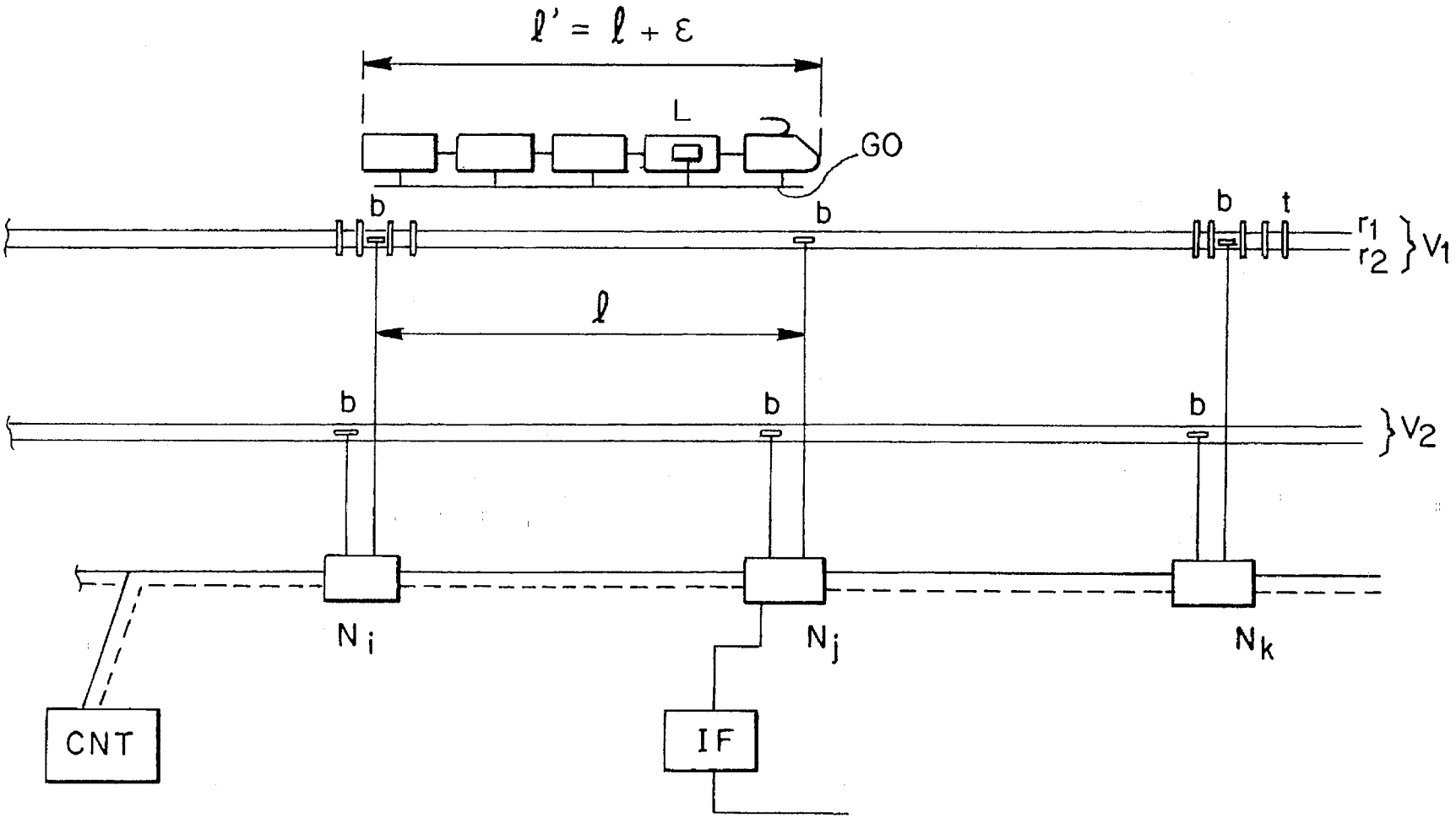

SYSTEM FOR TRANSMISSION OF INFORMATION BETWEEN THE GROUND AND MOVING OBJECTS, IN PARTICULAR IN GROUND-TRAIN COMMUNICATIONS

The present invention concerns the field of information transmission between the ground and moving objects. More specifically, it concerns, but is not limited to, the transmission of information between the ground and moving railway objects, pulling engines, cars, and train components.

Prior art encompasses various means allowing such communications. These means may be categorized according to various criteria, one of these criteria being the range of the area they make it possible to cover.

Some of these means have a localized zone of coverage; that is, an area restricted to several tens of centimeters or meters. Accordingly, they cannot be used when the moving object travels in certain determinate locations. Some of these means are unidirectional, such as conventional light signalling or its repetition in the car by means of metal contact or inductive loop. More recent techniques, such as ultrahigh frequencies or optics (infrared) permit the establishment of two-directional links between a moving object and a "beacon" having a high rate of output.

Other means have a larger coverage area. These means are basically radioelectrical. The transceiver with which the moving object maintains information exchanges (which, in some cases, are unidirectional) is found either in space (telecommunications satellites) or on the ground. In this latter case, there is, on an extraordinary basis, a station having a vast coverage area and, most often, by virtue of the frequency band used, a series of fixed stations whose range is limited to several kilometers, these stations thus being organized into a network. The informational output of these radio links is normally restricted by the relative narrowness of the available frequency band. More restricted yet than the overall output, the output per moving object is limited by the number of moving objects located in the coverage zone, among which the available output is shared.

A third category of communications means has a coverage area which is neither localized nor extended to a relative vast zone in its two dimensions. These means have a coverage zone which is, so to speak, linear, in order to cover a section of highway or railway. The means used might include a radiating cable, a loss waveguide, or even, in the case of the railroad, the rails themselves. However, in this instance, transmission is unidirectional.

The disadvantages of localized transmissions have long resided in their unidirectional nature. Recent progress has made it possible to provide two-way transmissions having a high output rate and at low cost. There remain disadvantages tied to the narrowness of the coverage zone, and, first of all, the impossibility of establishing contact with a moving object halted outside the coverage area. This is particularly bothersome in the case of sending to a stopped train the authorization to continue its progress, since the level of stopping accuracy makes it difficult for an engineer to stop within the coverage area of a beacon, even if this area is indicated. In the second place, there is the difficulty involved in sending to a stopping train the authorization to resume speed, so as to make traffic flow more smoothly and to save energy, except by multiplying the number of beacons. In the third place, the overall output rate available for ensuring transmission with a moving object is proportional not only to the output rate of the link once it is established, but also to the proportion of the time during which said link is established, i.e., to the ratio between the length of the area covered by a localized link and the spacing separating two successive coverage zones. Fourthly, even if the average output rate is sufficient, its discontinuous nature in time dictates that, for service such as the telephone, which requires continuity a priori, there be temporary storage, and thus a high apparent response time.

The disadvantages attaching to transmissions over a vast coverage area are basically of two kinds. First, the obligation to share among all of the moving objects served by the same link an overall output rate limited by the narrowness of the available frequency bands dictates that the output rate per moving object be generally very restricted. Second, the presence of obstacles to propagation (leaves, ditches, tunnels) or obstacles creating multiple paths (hills, buildings) forces acceptance of the fact that some zones may be poorly or not at all covered; or else, to guarantee the coverage of these areas, it results in the use of costly repetitive means. A third disadvantage impinges on certain very fast moving objects using radio transmission with a high modulation output and certain modulation procedures: this is the Doppler effect, which may prohibit digital links with excessively fast-moving objects.

The disadvantages of transmissions entailing linear coverage reside, as regards transmissions using rails, in their unidirectional nature and their very low output rate; as regards radiating cables, their cost and their still-limited frequency range (it is difficult today to go much above 1 GHz), which may prohibit the transposition on this special antenna (the cable) of a transmission in the open air (e.g., repetition in a tunnel of satellite links); and as regards slotted waveguides, their cost.

The present invention is intended to allow transmission between the ground and moving objects with a high informational output rate with each moving object, a coverage which is continuous in some cases, and at moderate cost.

The purpose of the invention is a ground-moving object transmission system using ultrahigh frequency transmission beacons such as those which are normally used to provide for localized transmissions, characterized by the fact that coverage extends in the direction of travel of the vehicle, by equipping it with an antenna or other radiating apparatus whose coverage in the direction of travel is very much greater than its value in the direction transverse to the direction of travel, and which may even, if this coverage reaches or exceeds the distance separating successive beacons, permit a continuous link during the travel of the vehicle.

Another purpose of the invention is a system of transmission between various beacons positioned along the course of travel of a vehicle specially fitted out for the planned ground/moving object transmission system and which provides, under optimal conditions, for the sharing of the available transmission resources and the routing of information between a Nodal Transmission Center and the localized beacons successively covered by the vehicle antenna.

In summary, the invention concerns a system in which the functions which, according to the state of the art for linear-coverage transmission, have been assigned to the ground and to the moving objects, are reversed. It is the ground on which are positioned, at more or less regular intervals, rather simple beacons (connected by a transmission network which forms the second purpose of the invention); and it is the moving object which carries a complex transceiver connected to a large-size antenna, such as a radiating cable or a slotted waveguide placed, for example, along the entire length of a train, and which, by means of this antenna, is in continuous contact with at least one localized beacon belonging to a group, if the distance between beacons is less than or equal to the length of the antenna, or which, if this distance is greater than the length of the antenna, provides a link which, while not being continuous, is present over a proportion of the path travelled sufficient to allow an average high output rate between the moving object and the ground. Because one beacon is in contact with at most one beacon at any one time, the output rate provided to one moving object is not provided to the detriment of the output rate provided to another moving object, for as long as the ground network connecting the beacons introduces no restriction.

The invention will be better understood from a reading of the preferred embodiment and of a number of variations of this process, which are provided solely to illustrate the invention and which in no way restrict its scope.

Figure 2:
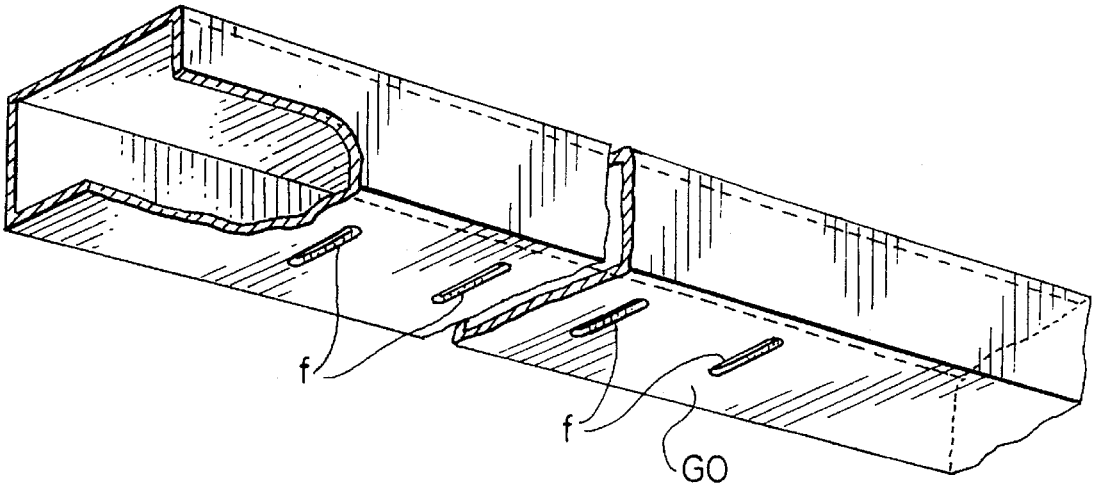
Figure 3:
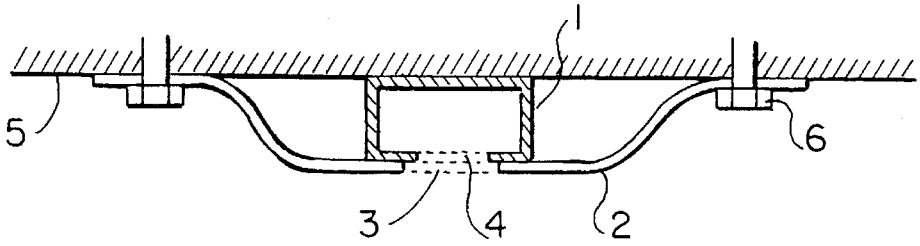
Figure 4A:
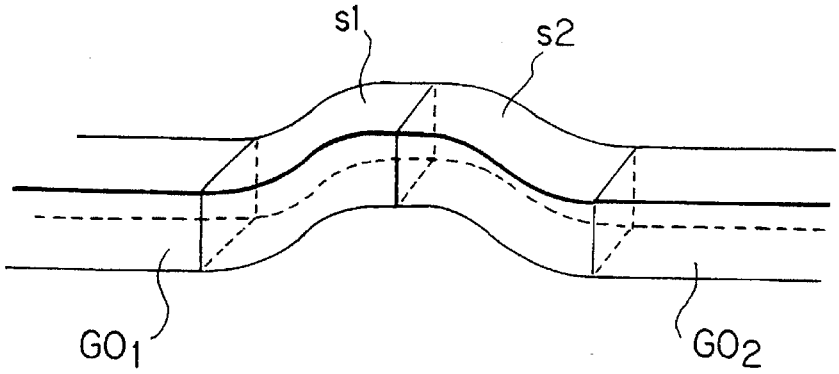
Figure 4B:
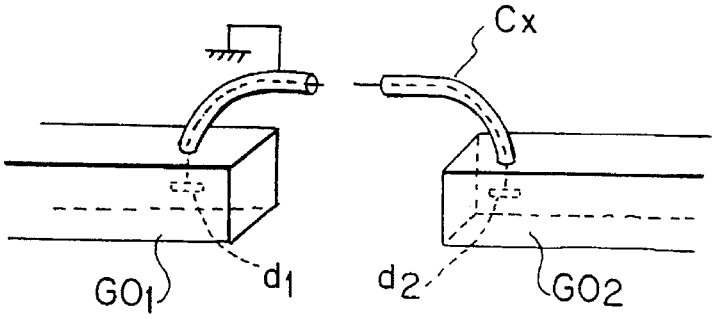
Figure 4C:
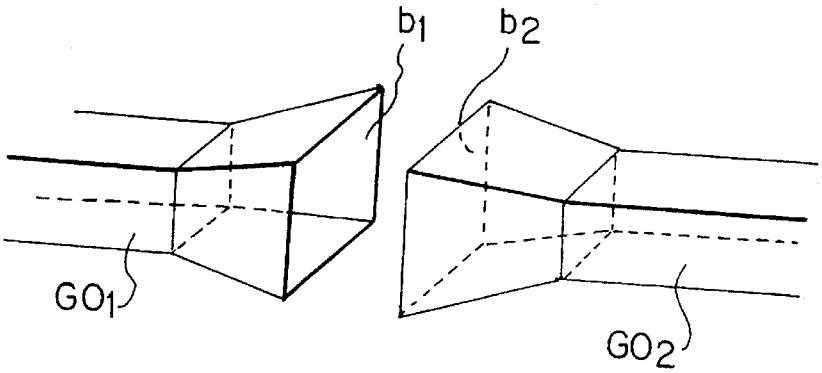
Figure 5:
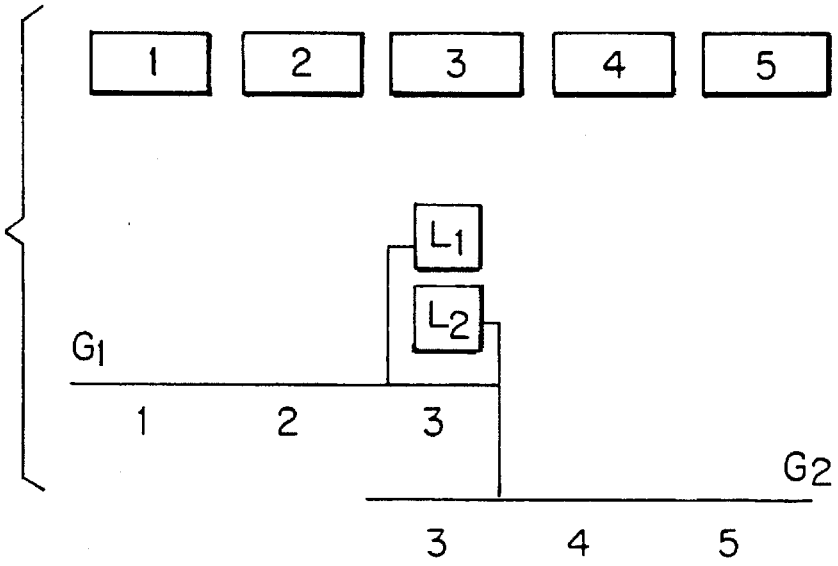
Figure 6:
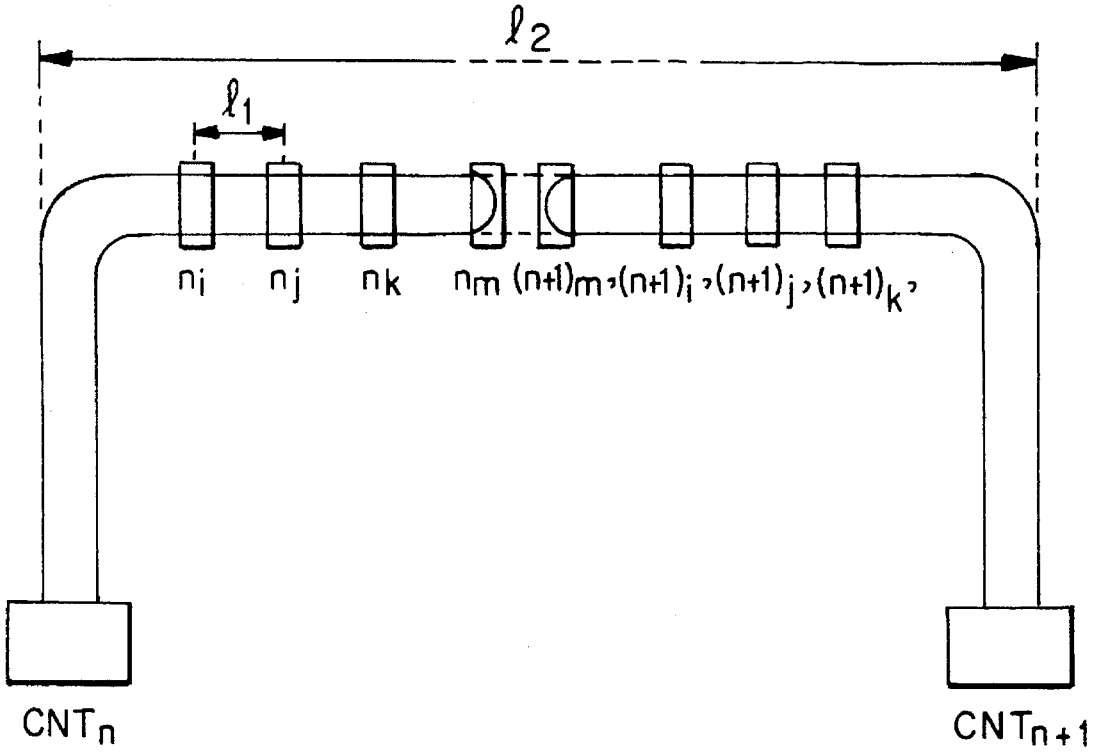
Figure 7:
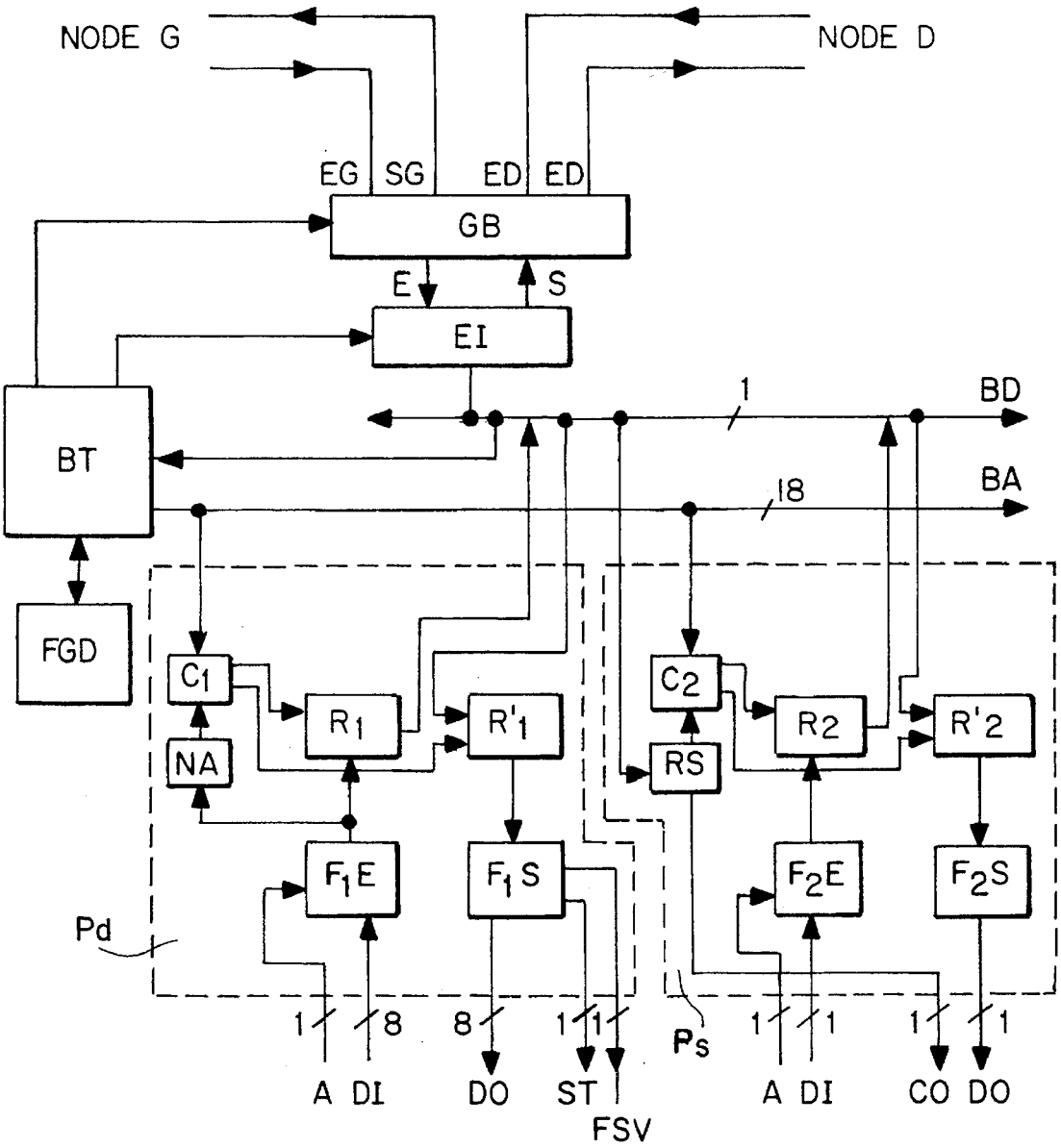

The features described above, as well as other features and advantages, will emerge in more detailed fashion in the following description of an embodiment furnished with reference to the attached plates, in which:

FIG. 1 is a diagrammatic representation of a section of a railway equipped with beacons and a transmission network which connects them to a nodal transmission center. Over this section travels a train equipped with a reader connected to an antenna arranged in accordance with the invention;

FIG. 2 provides the detail of a slotted waveguide mounted on a train and acting as an antenna arranged in accordance with the invention;

FIG. 3 provides the detail of a method for attaching the slotted waveguide beneath the body of the rail car and/or of components of the train;

FIGS. 4*a*, 4*b*, and 4*c* provide the detail of three possible methods for coupling waveguides mounted on adjacent vehicles within the train;

FIG. 5 illustrates the arrangement of the antenna-waveguide in two units, each of which covers one-half of the train and which make it possible to ensure the harmonious transition between one beacon and the next, in the case of continuous transmission;

FIG. 6 describes the architecture of the network connecting to each other and to a nodal transmission center the nodes, to which are attached the beacons and, potentially, other distributed equipment, such as switch controllers;

FIG. 7 illustrates the structure of a node.

The moving object which, in the case used as example, is a train, is equipped with a "reader" such as that recommended, basically for applications involving free-hand tolls or container identification, by the companies CGA-HBS (Hamlet system), Philips (Premid system), Marconi (Telepass system), or Amtech. This reader is coupled to an antenna arranged beneath the moving object.

It will be noted that the term "reader" within the context of the present invention designates an apparatus operating in alternating fashion and performing the following functions:

To transmit in the direction train-to-ground, it modulates a carrier wave, normally as regards amplitude. To read the content of the message awaiting reading in the beacon mounted on the rail line and intended for the train, the reader illuminates the beacon with an ultrahigh frequency, unmodulated wave. The beacon reflects back a portion of this wave, while modulating the reflected wave as regards amplitude (short-circuiting of the modulated antenna by means of the content of a memory such as a shift register), frequency, or, sometimes, phase, or by any other means.

The output rates of these readers are normally about 500 kbits/s and may reach 1 Mbit/s; however, the two-directional output rate is only one-half of this, since the response of the beacon, which requires unmodulated illumination, cannot take place simultaneously with the sending of a message to the beacon. Some systems have a more limited output rate, basically for the purpose of reducing the energy consumed by the beacon; however, this consideration is of lesser importance with respect to the invention transmission system, in which remote feed of the beacons through the ground transmission system will most often prove possible.

FIG. 1 shows that two tracks $V_1$ and $V_2$ are illustrated, each of which comprises two rails such as $r_1$ and $r_2$. Beacons such as b and incorporating an antenna are placed on the tracks between two cross-ties t, or on one cross-tie. The reader L borne by the moving object, is connected to the waveguide placed beneath that object. In a first phase, it will be assumed that the moving object is a locomotive having a length of 12 meters and towing a freight train. It will be supposed that the antenna of the moving object is a slotted waveguide G.O. located beneath the body of the moving object on the center line, and that its coverage area is 15 meters (i.e., 1.5 meters more on either side than the length of the guide). That is, it will be assumed that, when the moving object travels, the link with the localized beacon b above which the object travels is possible over 15 meters of its course of travel.

Supposing that the accuracy of train stoppage effected by the engineer is plus or minus 5 meters, it can been seen that the antenna providing 15 meters of coverage allows the engineer to stop the train above the beacon, so as to ensure its ability to receive the authorization to continue its operation. Supposing that a normal "localized" antenna installed beneath the body of the locomotive makes possible the exchange of data only over a distance of 1.5 meters on either side of the site of the beacon, it can be seen that the antenna providing 15 meters of coverage area permits an exchange of volume of data that is five times greater. Supposing that the distance separating two successive beacons is l=200 meters and that the average output rate in the coverage area is 256 kbits/s, it can be seen that the average output rate accessible to the train travelling at constant speed is 19.2 kbits/s, whatever that speed may be. Assuming that a telephone conversation requires an output rate of 16 kbits/s, it can be seen that the engineer can speak with the ground regulator, provided he accept a delay in the vocal transmission equal to the time required to travel through the area not covered between two beacons. For a speed of 100 km/h, this delay is 6.6 seconds.

Let us now suppose that the moving object is not a locomotive pulling a freight train, but a train comprising rail cars. We will use the example of the TGV-Atlantique [Very High Speed Train], whose length is l'=l+=200 meters. We shall assume that the antenna exists as a slotted waveguide running beneath the entire length of the train, thus covering a distance slightly greater than 220 meters, and, therefore, the distance separating two beacons, always assumed to be 200 meters. Under these conditions, the train is continuously above at least one, and sometimes two beacons. It will be seen below how potential interference between two simultaneously-covered beacons is avoided. Keeping the preceding numerical values, it will be seen that the train is not only continuously covered, but that it has continuously available an output rate of 256 kbits/s. This rate makes it possible to transmit approximately 15 telephone communications without any appreciable transmission delay, and/or a significant volume of data used to operate the railway or making it possible to offer rail services to passengers (time-tables, reservations), and indeed, to offer them mobile office automation services (accessing data-bases, fax transmission, etc.). It may also be observed that, when the train comprises two components each 200 meters in length, each of them can use the indicated transmission capacity, without requiring that component share with the other component or with other trains anything other than the use of the ground network connecting the beacons to the Nodal Transmission Center.

The various beacons are connected to nodes, e.g., (Ni), (Nj), (Nk), which are spaced apart by 200 meters. These nodes are, in turn, linked to a Nodal Transmission Center (NTC), such as an NTC on the one hand; on the other, they may be connected to a stationary rail facility (RF) such as (RF), which controls, for example, a switch motor.

FIG. 2 illustrates an embodiment of the antenna of the moving object. The creation of this antenna rests on the use of a slotted waveguide (GO), such as that used in the IAGO system of ground-train links, developed by the GEC-ALSTHOM company. This system is described, most notably, in French Patent No. 2,608,119 dated Dec. 12, 1986. However, in this system the waveguide is placed on the track, and the train has a localized antenna connected to a conventional ultrahigh frequency transceiver. For a frequency of 2.45 GHz, the waveguide exists as a rectangular tube made of extruded aluminum, whose dimensions are approximately 10.5 cm×5.5 cm and into which slots (f) perpendicular to the track are cut, these slots being spaced apart by about 4.5 cm.

FIG. 3 shows the detail of a method for attachment of the slotted waveguide beneath the body of the car and the train elements. This method ensures at the same time the attachment and protection of the waveguide To this end, the waveguide 1 is protected from ballast protrusions by a steel strip 2 incorporating slots 3 in such as way as not to mask the slots 4 in the aluminum tube, and which provides for the attachment of the tube beneath the body 5 by means of bolts 6, e.g., bolts screwed into the body 5. The edges of the slots in the strip are bevelled, as shown in FIG. 3. At the frequency cited, i.e., 2.45 GHz, the attenuation produced by the guide and its slots is approximately 18 db/km, or 4 dB over the length of the train, and 2 dB only if the reader is positioned in the middle of the train and feeds two half-guides, each 110 meters long.

The guide placed under the body of the car or of a trailer coach is rigid. Now, the non-deformable train is jointed around ball joints normally positioned just below inter-car accesses allowing passengers to move from one trailer coach to another. Several solutions can be implemented to ensure the connection of the waveguides on adjoining coaches.

Three possible connection solutions are summarized in FIGS. 4*a*, 4*b*, and 4*c*.

The first of these solutions, shown in FIG. 4*a*, consists in the use, within the connection area, of a flexible waveguide such as that found in some radar installations. This connection consists of a flexible portion, potentially formed from two flexible, separable parts $s_1$ and $s_2$, which are connected to the waveguides $GO_1$ and $GO_2$, respectively.

The second of these solutions, illustrated in FIG. 4*b*, consists in connecting the two adjacent waveguides $GO_1$ and $GO_2$ by means of a coaxial cable Cx, which may potentially be separated in two parts, whose ends join the interiors of the waveguides and ensure continuity by means of dipoles $d_1$ and $d_2$. The shift from transmission by waveguide to transmission by coaxial cable, or from the latter to the former, causes the loss of only about 1 dB/meter, so that travelling over 11 points of separation between trailer coaches (extreme case in which the reader is positioned in one of the cars) absorbs only a little more than twelve dB. To protect the coaxial cable against ballast protrusions, it is advantageously placed in a sheath such as hoses which, in conventional trains, are used to make pneumatic connections. A sheet-metal plate may be used to strengthen this protection.

The third solution as illustrated in FIG. 4*c* may be used on an articulated train such as the TGV, in which the relative movements of adjoining trailer coaches limit the clearance separating one guide from the adjoining one. This solution consists in positioning these guides opposite each other as much as possible, so that one captures virtually all of the radiation emanating from the other. To this end, each of the facing ends of the waveguides $GO_1$ and $GO_2$ is extended by an aluminum part having the shape of a truncated pyramid whose small base corresponds to the cross-section of the waveguides, and whose large base is homothetic with that section. Given the short clearance between the two ends of the waveguides, the loss of radiation is effectively reduced.

The patent mentioned above indicates how use may be made of a slotted waveguide to measure speed in safety. This measurement depends on the injection of a frequency such that, between two successive slots, the wave travels by approximately the distance of one-half wavelength. In this case, an antenna positioned at a short distance from the guide detects nodes and antinodes, the count of which allows the antenna to register the distance travelled (and for which the quotient of this count by time allows it to register the speed). This possibility can be utilized by the reader. If, in addition to the frequency of about 2.45 GHz employed for transmission, it injects a frequency of about, 2.7 Ghz, the signal reflected back to it is modulated as a function of the spacing of the slots.

When the train is in a position such that it covers two beacons simultaneously, one at the front and the other at the rear, there is no radioelectric interference in the train-to-ground direction (even though, since the information is received by two distinct beacons, it proves more economical that only one transmit this information to the nodal transmission center). On the other hand, if the reader illuminates two beacons using a single unmodulated frequency and if these beacons modulate the reflected wave, it is very possible that the two waves received by the moving object will interfere with and make difficult the proper reception of the information (even though, if the reader is positioned at one end of the train, it is possible that there would be capture of the most attenuated wave, which has travelled the length of the train twice, by the wave, less attenuated, which has travelled only several meters of the train).

Several methods can be used to overcome these disturbances.

One embodiment is illustrated in FIG. 5.

A first method would entail use of two readers $L_l$ and $L_2$ emitting over slightly different wavelengths, so that signals at different frequencies can exist at the same time without disturbance of their reception. These readers would be mounted at point 3, i.e., the middle part of the train.

In another solution, the reader would be positioned in the middle of the train at 3 and could transmit, by choice, through one or the other of the two guides $G_1$ and $G_2$, each of which extends over one-half of the train. The emission of a short message and the measurement of the quality of the response of both guides allow the reader to select one of the two beacons (and, by informing that beacon that it has been selected, to ensure that beacon instructs the nodal transmission center to address to it the messages intended for the train).

However, the preferred method is a different one. It entails transmitting continuously over two frequencies approaching 2.7 GHz but distinct one from the other, in order to instruct at least one of them to measure speed continuously, because the half of the guide in which it is sent covers one beacon. This method involves the use of sometimes the first beacon, and sometimes the second, while providing for an overlap during which both beacons are covered and can both supply the speed in a fail-safe arrangement. The determination that a new beacon has responded (and that a measurement of the related quality has been made) makes it possible to decide at what moment one or the other of the two waveguides can be used to channel the transmissions.

It will be understood that the intensive but sporadic nature of the output rate of one beacon; the distribution of the beacons all along a line at intervals which permit a transmission from one to the other at a high baseband output rate; the fact that two trains passing in succession over a given track are normally spaced apart by a distance which often exceeds 2 kilometers, or in other words, the fact that a single train passes over a certain section of the line; the desire to avoid the case in which a break in a transmission line would entail the impossibility of communicating with the trains passing over a certain section of the line; the relatively high number of beacons, which makes it desirable that the communication nodes to which they are connected have a simple structure; and the fact that these nodes may also be advantageously linked to stationary facilities such as switch controllers or systems for announcement of grade crossings, all constitute features specific to the transmissions which are to link the beacons to the nodal transmission center. For these reasons, the ground-train communications systems according to the invention are advantageously supplemented with an adapted, dedicated system for the management of ground communications, which is, so to speak, the guarantee of high levels of performance and of economy of operation.

The preceding description will be taken up again in greater detail with reference to an embodiment illustrated with respect to the FIGS. 6 and 7.

An ultrahigh frequency short-range transmission may thus be the "ground-train jump" link of a communications network between a transmission center and all of the trains travelling over a line. In order for this network to be advantageous in its entirety, it is necessary, in addition, that the ground ultrahigh frequency beacon-link network offer a performance level compatible with the performance level of the beacons, a high degree of availability, and a moderate cost. Moreover, this system must be able to handle other transmissions intended for stationary points located on the line or in proximity to it, i.e.: fixed ground-train radio stations, switch motors and controllers, level crossing-management systems, telephone-access terminals if used, etc.

We describe below the outlines of a possible solution based on a loop connection of rudimentary nodes installed close together and profiting from the dynamic management of a power capacity which, because of that arrangement, can remain limited, taken as a whole.

Consideration will be given, in succession, to the following:

1. system appearance,
2. resistance to breakdowns, or reconfiguration process,
3. transmission management,
4. frame format,
5. the architecture of the node.

1. As regards system appearance, several assumptions will first be made concerning the beacons and their positioning:

It will be supposed that the desirable output rate over the link between a beacon and what will be called the Nodal Transmission Center (NTC) is approximately 250 kbits/s, full duplex. This figures presupposes a ground-trains transmission at a bit rate of more than 500 kbits/s, since this transmission must necessarily be made in an alternating mode. The bit rate must be greater than twice the bit rate of the link with the NTC, since consideration must be given to the exchange of service data between train and beacon, return times, and idle times linked to the train's determination of the beacon to be used when it is located above two beacons at the same time (although the use of two readers or of a second frequency used, for example, to measure speed in a fail-safe manner allows this determination to be made in masked time). The available passbands easily permit this bit rate. The consideration which sometimes limits this rate, i.e., the economy of a battery which is supposed to last for several years, will probably not be a factor if the beacons are remote-fed by the connection network.

It will be supposed that the spacing between two consecutive beacons on the same track is 200 meters. Of course, it does not have to be that short on all of the lines, but 200 meters is the maximum spacing guaranteeing continuity of coverage to a TGV train 200 meters in length, and thus, offering services (e.g., the telephone) which, in order to be of commercial quality, require this continuity.

Using these values, it will be understood that the required connecting network must exhibit totally unconventional characteristics:

- a very high number of beacons to be served, distributed linearly, and separated one from the other by a very short distance;
- a very small proportion of the beacons must, at any given time, be in contact with a train; i.e., for an average spacing between TGV's of 20 kilometers, a proportion of 2% if the trains are double ones, 1% if they are single; and, for locomotives spaced apart by 3 kilometers and having a coverage area of 15 meters, the proportion is 0.5%;
- a high speed of deformation of the traffic pattern (for a TGV travelling at 360 km/h, contact with the beacon lasts only for 2 seconds; for a locomotive travelling at 110 km/h and whose waveguide provides a coverage area of 15 m, this contact lasts for only 0.5 second);
- for beacons in contact with a train, an instantaneous bit rate which may be very high, but which is doubtless not the same for all;
- a high level of concern for availability, to the extent that the network must constitute a tool for command-control of traffic.

Taking these features into account, one is led to imagine a network whose characteristics are as follows:

- one node every 200 meters,
- an MICTN1 link at 2.048 Mbits/second,
- a double loop link between two Nodal Transmission Centers,
- direct addressing of trains, leading to a simple nodal structure.

a) Nodes Spaced Apart by 200 Meters

If the beacons on a single line are spaced apart by 200 meters (it being understood that the case of a spacing of greater magnitude must also be contemplated), several spacing arrangements for the nodes can be contemplated:

- 100 meters for a double-track line, provided that they are arranged and connected in a staggered pattern, 200 meters for any line whatever, with the understanding that, if there is more than one track, one node must connect several beacons, greater than 200 meters (e.g., 400 m, if a node is positioned half-way between two groups of beacons, either 100 meters away from each one, or 600, if a node is placed beside one group of beacons and if it is responsible for connecting both groups located 200 meters away).

It appears that the 100 meter distance does not have to be selected, since the solution must encompass all cases.

It seems that the 400 meter or greater distance does not have to be selected, since the wiring may become complex, availability poor for an entire group of beacons, and since one high bit rate transceiver with a range of 400 meters, more than four transceivers having a lower bit rate and a range of 100 meters may be more expensive than two transceivers having a higher bit rate and a range of 200 meters, plus an additional node logic.

Accordingly, the hypothesis of a node every 200 meters will be selected. Each node must control one beacon (on a single track), two beacons on a double track, and, in fact, even more on some lines or in station areas. The node must, moreover, control connections of adjoining stationary equipment (stationary ground-trains radio stations, switch controllers if they are controlled by IPOCAMPE, level crossings, etc.).

b) MIC TN1 Link at 2.048 Mbit/s

One important choice bears on the carrier, i.e., fiber optic or copper. Fiber optics have the advantage of complete insensitivity to disturbance and of high capacity. They have the disadvantage that, at present, there are fiber optics only over a relative small, although growing, line distance measured in kilometers, while copper is widely used. It also has the disadvantage that its transmission-performance levels presuppose, in practice, powerful nodes, which may thus prove expensive.

If use is to be made of ordinary copper carriers, the quad cable having a diameter of 0.4 mm, one limits oneself, in practice, to the lowest level of the MIC links, the TN1 link providing a bit rate of 2.048 Mbits/second.

It must nevertheless be observed that the standard of the PTT (Office of Posts and Telecommunications) calling for a distance of 1,800 meters between MIC repeaters on copper quad cables having a diameter of 0.4 mm doubtless offers an economical solution for lines over which continuous transmission is not desired.

It may be thought that the cost of an HDB3 repeater (two integrated circuits and a tuned winding) constitutes the upper limit of what will be the cost of a transmission occurring at the same bit rate over a length limited to 200 meters.

Provided effective management of capacity is ensured, the rate of 2.048 Mbits/s allows the connection of about seven TGV trains, which would simultaneously use all of the 250 kbit/s capacity, which was held to be assigned to each one (or less, if some of these trains comprise multiple elements). For an average spacing of 20 km, one MIC link would allow the management in normal time of about 70 km. It will be seen further on that it appears advantageous, in that case, to double the spacing separating the NTC's (about 150 kilometers), a failure being signalled by the fact that one among these centers would then have to control only a portion of its previous load; but the adjoining NTC would then have to control the beacons that it can no longer connect. Under these conditions, a cut-off of the link would, in the worst case, entail a one-half division of the capacity that could be allotted to one train.

The discussion above shows that one TN1 link, provided it is managed dynamically, allows the management of several tens of kilometers. This is, a priori, an acceptable value. Above all, the limits are easily pushed back if the individual bit rates increase, if the spacing separating the trains is reduced, or if the management of longer line sections is desired. It is necessary only to connect directly, by means of a conventional MIC link, subsections of the line section to be managed. It will thus be accepted that transmission occurs at a bit rate of 2.018 Mbits/s.

c) Loop Link (FIG. 6)

An overall bit rate this low cannot be effectively shared among nodes, each of which can "call" a bit rate as high as though all of the information were accessible in each node. This leads to the choice of a loop structure, in which each node retransmits to the adjoining one all of the information it has received, as potentially modified by virtue of what it has itself extracted or added.

In one way or another, it is indeed necessary that the loop be looped in so that the NTC controls both emission and reception. The simplest solution dictates that the return path be the same as the outgoing one, i.e., that the topology be that of a loop using only a single line for outgoing and incoming transmissions.

Strictly from the standpoint of logic processing, it is not necessary that the information travel backward in each of the nodes through which the outgoing information was transmitted. Nevertheless, this arrangement is advantageous from the standpoint of transmission and of reconfiguration.

As regards transmissions, it is possible to contemplate a return with "Seven League Boots," using, for example, a repetition spacing of 1,800 meters and thus jumping eight nodes at one time. However, this leads to a quite asymmetrical solution. Moreover, the only points where reconfiguration would be possible are those in which transmission in both directions is possible. This would imply that a breakdown could "blind" a relatively large portion of a line. This does not appear acceptable.

It will thus be admitted that each node $n_j$ is connected, in both transmission directions, to each of its adjoining nodes $n_i$ and $n_k$. On the other hand, the information will be processed only in one direction; the other will be limited to the repetition and reconfiguration function.

If it seems a priori expensive to provide fail-safe protection for each beacon, and even each node, because the consequences of a breakdown of such a localized nature are a priori minor, the same is not true for protection against breaks in the link. It is certain that these cut-offs will occur.

It appears insufficiently effective to provide for fail-safe protection by means of another link which takes the same route, since the assistance would be vulnerable to the same event as that affecting the normal link. It seems virtually impossible, and, in any event, ruinous, to ensure operation of each node by means of a link taking a route other than the line, e.g., a PTT link.

The proper solution appears to consist in assisting a link by means of the link extending it; in other words, to attach a line at both ends, each being connected to a Nodal Transmissions Center. This does not mean that, under normal operation, each end must play a part in the connection of a given node, but only that it must be possible, in the event of the break of the link, to connected to one NTC all of the nodes positioned on the same side of the break as the NTC.

d) Direct Addressing to the Trains

The logic structure of the network dictates that a distinction be made among several levels:

The Nodal Transmission Center (NTC), responsible for the management of a line and of the connections to other networks or servers;

the "node," a step on the ground link responsible locally for transmission, reconfiguration and extraction or insertion of information into the loop;

the "beacon," including the controller which manages it; and the "train," final addressee of exchanges (it is assumed that the train performs the functions of a bridge in relation to the true final addressees, i.e., the on-board systems or telephone).

Given the speed of traffic reconfiguration required when a train travels from one beacon to the next, and given the desire to limit overhead, it would appear advantageous to look for a solution in which, to "speak" to the train, the NTC would not explicitly address the node providing connection at that moment, nor even the beacon, but the train directly, without worrying about its current location. In this way, the change of beacon by the train is of importance only to the train itself, the beacon it is leaving, and the beacon into whose orbit it is entering. The "hand-over" is of importance only to the NTC. This arrangement reduces its work load and, in particular, accelerates the process and facilitates the non-interruption of a continuous flow of data.

This presupposes that the train, aided by its dialogue with the beacon, is capable of placing in the node the information making it possible to intercept the data intended for it, and of knowing when and at what location to inject data supplied by the train.

Similarly, the addressing of the train by the NTC must be as effective as possible, in order to limit overhead. Given the small number of trains located at any given time within the range of control of an NTC, this suggests that shortened numbers be allotted to them dynamically.

2. As regards the management of failures, reconfiguration of the system will be effected as explained below.

It has been indicated that the most appropriate connection structure appears to be that of a ring folded over on itself and in which each node has flow going through it twice, the first time providing for logic processing, and the second time, as a simple transmission repeater.

It has also been indicated that protection against a break in the link leads to considering connecting together all of the nodes between two locations fairly distant from a line (it will be assumed that $l_2$=200 km) to two NTC's located at both ends, and to looking for a fail-safe protection making it possible to vary the limit of the ranges of control of each one.

The way in which these principles can be applied will now be examined, with reference to FIGS. 6 and 7.

Since, in the following description, reference will often be made to the structure of a node as shown in FIG. 7, the meanings of the various components designated by letters are listed below.

(EG): left input (GB): loop manager (ED): right input (E): input (SG): left output (S): output (SD): right output (EI): extractor/injector (BD): data bus (BA) address bus)

(BT): time base (FGD): dynamic management FIFO (Pd): dynamic gate ($P_S$) static gate ($C_1$): comparator ($C_2$) comparator (NA): shortened number (RS): selection register ($R_1$):, ($R'_1$): registers ($R_2$), ($R'_2$): registers ($F_1E$): input FIFO ($F_2E$): input FIFO ($F_1S$): output FIFO ($F_2S$): output FIFO (A): Attention (DI): data in (DO): data out (ST): Frame synchronization (CO): Clock out (FSV): FIFO output empty All nodes are identical. Each has two inputs EG and ED, two outputs SD and SG, and a logic L. It can function according to four modes, calling the logic part L:

1. EG to L to SD and ED to SG: case of an intermediate node ($n_j$) on the left;
2. EG to L to SG (ED and SD not being connected to anything); case of the last node on the left ($n_m$);
3. ED to L to SD (EG and SG not being connected to anything): case of the last node on the right ($(n+1)_m$);
4. ED to L to SG and EG to SD: case of an intermediate node on the right $(n+1)_j$.

Without overly anticipating the technical solution chosen, it will be assumed that solution utilizes the transmission of stationary 8 kbit frames, thus corresponding to a frequency of 250 frames/second). It will also be assumed that each frame comprises a synchronization pattern and can contain an area carrying a command (it will be seen below that this area can consist of the first bytes of the Static Capacity Assignment area).

A loss of synchronization on more than n frames (n=16?) places a node in a reconfiguration mode. In this mode, it is placed in pure transparency; i.e., its logic L injects no bits. In this transparency mode, it swings between modes 1 and 4, while remaining in each one for a duration of about two frames, until it has "locked onto" the synchronization frame.

The case of a complete initialization and of an intact link will be considered. The NTC 2 emits nothing in a first phase. The NTC1 continuously emits a frame comprising only the synchronization pattern and 1 in the rest of the frame. The nodes which have recovered synchronization will remain in mode 1, where they are locked on, this process occurring step by step, beginning with the node closest to the NTC1. If the unlocked nodes switch between mode 1 and mode 4 about every two frames, it can be seen that they will be locked onto the NTC1 at a rate of a little more than one per frame (on average, two in 1.5 frames; at the moment when the node is locked on, its adjoining node has one chance in two of being in a phase in which it is also locked on. The node adjoining the adjoining node thus has one chance in four, and so on; i.e., approximately two nodes on average are locked on simultaneously. The first node not to be locked on is not locked on because it was oriented in the wrong direction; it has one chance in two to be locked on with the next frame, and one chance in two of waiting until the next. However, when it is locked on, there will be, on average, another to be locked on at the same time). If $n_1$ is the number of nodes to be managed by the NTC1, it can be seen that, after $n_1$ frames, it is virtually certain that the last node to be managed, termed m, has been locked on (if one waits longer, all of the nodes between the NTC1 and the NTC2 will end up being locked on in mode 1 by the NTC1; accordingly, a decision may be made to await until that instant). With a frequency of 250 frames/second and a node spacing of 200 meters, 100 km of line will be "locked on" in 1.5 seconds.

The nodes which have locked on the synchronization receive 1's in the entire part of the frame which is not constituted by the synchronization pattern. Thus, they receive mode 1 in particular in the first two bytes of the Static Capacity Assignment area, these bytes generally designating a node by a number of 12 bits, and a gate of the node, by a number on 4 bits. The code they receive in this area, i.e., 65535, normally designates gate 15 of node 4095 (which must not exist). This code will be interpreted as giving the order to remain in the reinitialization mode.

The NTC1 will then address to node m, designated by name, an order to shift to mode 2 (a Static Capacity Assignment specified by its node number and, for example, by gate number 15). The NTC1 will then receive, through the loop which is finally closed, the following part of the information it was sending. Reinitialization of the first loop is completed. NTC2 can then proceed in similar fashion, by sending the initialization pattern on which, step by step, all of the remaining nodes will be locked on. There is, in fact, no competition to be feared from the NTC1, since the node m is looped in mode 2. When all of the remaining nodes have been locked on, the NTC2 may send to the most distant, mode m' the order to switch to mode 3 (a Static Capacity Assignment specified by its node number and, for example, gate number 14). Initialization of the second loop is completed.

In normal mode, i.e., not involving a break in the link or a node failure, the NTC's can agree to move the boundary of their respective areas of operation. The NTC which restricts its operating are must do so first, by sending the looping code to the new last node. It will be supposed that it is the NTC1. The abandoned nodes then switch, with the passage of a time delay, into the synchronization-search mode; if $n_2$ is the number of nodes to be placed under the control of the NTC2, the latter must switch to the synchronization mode for a duration of approximately $n_2$ frames (the other frames not having lost their synchronization). It can then send the looping order to the new last node.

It can be seen that, during this rearrangement process, some nodes have not been able either to receive or transmit, while others continued to receive but could not transmit. This is, therefore, a process which it is better to avoid. If, however, it is to be implemented, it is better to proceed node by node, so as to reduce the duration of the disturbance (one dozen ms).

In the event of a break in the link or of failure of a node, the process to be implemented is similar to the process just described. The NTC receiving no more information in return switches into the resynchronization mode, then attempts gradually to reloop over the nodes drawn progressively closer together, until the loop is established. The NTC then knows what node has established the loop. It so informs the other NTC, which attempts to extend its area of control up to the node adjoining the node in question.

3. As regards transmission management, the following description presupposes that the interface between a beacon and the node to which it is connected is effected, as indicated further on, by means of an input FIFO $F_1E$, an output FIFO $F_1S$, an input control wire (Attention) (A) and two output control wires Synchro Frame and FIFO empty ST and FSV. The interface thus, in principle, consists of 19 wires, which can be reduced to 12 if the data wires are multiplexed.

a) Case of a train profiting from a shortened number and covered by a beacon, or a beacon already covered, for a certain time period by a train. The node has known for a certain time period the shortened number of the train, which it has assigned to the gate through which the beacon is connected.

At the beginning of each frame (every 4 ms), the node writes in the output FIFO $F_1S$ the number of the new frame, and emits a signal over the Synchro Frame Wire ST. When it receives this signal the beacon knows that the bytes intended for the train within the frame i-1 are located in the output FIFO $F_1S$, these bytes ending with the additional byte providing the number of the new frame. The number of data bytes received by a node during a frame is always equal to the number of bytes transmitted by the node within this same frame. This number is, therefore, known to the beacon, which has had to take note of this number during the preceding frame. The beacon can "get ahead of schedule" in the reading of the data bytes, by testing the empty state of the FIFO.

The beacon can, when questioning the train, transmit the received data bytes to the latter. It must also indicate to the train the number of the new frame, so as to maintain synchronization, which needs only be approximate.

The beacon is responsible for having fed in time to the input FIFO $F_1E$ at least the number of bytes to be transmitted to the new frame i; the train is, in consequence, responsible for having supplied these bytes in time to the beacon. The beacon receives the indication of the number of bytes to be transmitted (and the corresponding data bytes) by the train. This number will most often be the same from one frame to another, but nothing prevents that number from varying in accordance with a rule known to the train. Timely transmission means that they are sorted in the input FIFO $F_1E$ before the node has the opportunity to transmit them. Since the beacon does not know what this moment will be, it must assume that transmission begins with byte 64 of the frame, but nothing prevents it from getting ahead of schedule. When the input FIFO $F_1E$ is empty while at the same time being requested to supply data bytes, replacement transmission takes place, in which the bits received from the upstream end are recopied. This behavior is used in the hand-over.

b) Case of a train covering a new beacon, while still maintaining contact with the preceding one.

If a train approaches a new beacon i, it begins a dialogue with it (but, up to a certain moment, not with the NTC through the this beacon). Once the link quality proves satisfactory, the train indicates to the beacon its shortened number. It also tells it the frame n beginning with which it wishes to effect hand-over, i.e., the use of the new beacon i for exchanges with the NTC, rather than the current beacon j. The train tells this to the beacon i, but is not concerned with so informing the beacon j.

During the time-period corresponding to the frame i-1, the beacon re-enter the shortened number in the input FIFO $F_1E$. Next, it sends a signal over the Attention (A) wire. This causes the node to read the shortened number, its duplicate copy in the selection register associated with the gate and in the output FIFO ($F_1S$). Accordingly, the beacon has the opportunity to verify that the shortened number has been correctly received and, should reception have been incorrect, to retransmit said number.

The train transmits to the beacon i the data to be sent within the frame n. The beacon enters the data in the input FIFO $F_1E$, which connects this beacon to its node. During transmission of this frame n, it is, again, from the beacon j that the train must read the data addressed to it in the frame n-1.

Since the train has sent to the beacon j no datum to be transmitted in the frame n, the input FIFO $F_1E$ of this beacon cannot supply data when the selection mechanism provides it with the opportunity to do so. The empty state of the input FIFO $F_1E$ causes not only the non-emission and its replacement with the transparent retransmission of the bytes received from the upstream node, but also the deselection of the gate, i.e., the reset of the selection register associated with the gate to which the beacon j is connected. The node j has become, once again, available for a succeeding train.

It should be noted that any underrun has the same effects as a beacon-use end-point. It is essential, therefore, to avoid the obstruction that would result by virtue of the fact that the input FIFO $F_1E$ can contain the end of the data to be transmitted, which would prevent reinitialization by the train which had caused the under-run, or initialization by the following train. For this reason, the under-run must cause the emptying of any content in the FIFO at the beginning of the following frame.

c) Case of a train covering a new beacon while no longer being covered, but which has a shortened number.

When quality contact is established with the beacon, the train transmits to it its shortened number and the indication of the frame beginning with which it wishes to transmit (i.e., in principle, the next frame). The node, which knows the shortened number but which has not received in the frame any indication of the capacity assigned to the train, emits at the end of the frame a request for assignment of capacity. A certain number of frames will occur before the NTC has received this request, processed it and decided upon an assignment, and before it can indicate the assignment in an outgoing frame. Until this moment, the node will retransmit the request for assignment in each frame. When it receives an assignment, it will know that the corresponding bytes in the frame received are to be transmitted to the beacon, and the number of the frame will constitute for the train the implicit indication of the number of bytes transmitted and thus, to be replaced. In practice, the link will have remained inactive only for the physical time needed to travel through the loop, plus one frame duration.

It is likely that the data transmitted by the NTC through the last two frames sent to the preceding beacon cannot have been received by the train, unless the train has intentionally decided to stop transmitting while still being effectively covered by this beacon. It is the responsibility of the procedure used between the NTC and the train, or of the processes occurring at a higher level, to ensure the required resumption.

d) Case of a train covering a new beacon while not yet having available a shortened number.

A train that does not yet have a shortened number (because it is entering the area covered by the NTC in the absence of an announcement by the NTC it has left, or because it is emerging from a period of inactivity) uses a null value as its shortened number. This is detected by the node when the selection register is being loaded, and causes the node to send to the NTC a message requesting the assignment of a static multiplexing capacity with the train, specified not by the shortened number it does not yet have, but by the number of the node and the gate to which the beacon is connected.

The link thus established is created between an addressing/capacity-assignment process within the NTC and an initialization process in the train. This exchange allows the train to indicate its complete machine number and its desires regarding capacity. In return, to the extent that it has free shortened numbers, the NTC indicates to the train the shortened number it must use and the bit rate assigned, i.e., the number of times there will be 32 bytes per frame or in each of the 16 frames of a multiframe, if this capacity is not constant. Once the initial dialogue is completed, the NTC breaks off the static link. After having recognized this break-off by virtue of the fact that it is no longer receiving bytes in the output FIFO $F_1S$, the beacon initializes dynamic exchange, by placing in the input FIFO $F_1E$ the shortened number of the train and by sending to the node the signal of Attention by A.

The disassignment of a shortened number is made automatic by outflow of a time delay in the absence of transmission (e.g., lasting five minutes). To avoid any interpretation error, the NTC waits for an additional time-period before reassigning the same shortened number to another train.

When a dynamic capacity transmission is established, the train may be forced to request the NTC to modify its bit rate, for example because of the emergence or disappearance of new needs). The train must do so through the data flow it sends to the NTC, of which it is assumed that a sub-set is intended for management of the link. The NTC may by itself modify the bit rate, either because of a change in needs or in order to distribute the lack thereof.

3) Connection to objects having static capacity

The connection of objects having a static capacity (e.g., stationary ground-train radio station or switch controller) is fairly similar to the train connection, except for a few differences:

The bit rate can be made uniform by the use of FIFOs. Since it is relatively slow, the data may be exchanged over a serial link. Two wires, one per direction, are sufficient.

Since the capacity is fixed, it requires no control wire other than a clock, which is supplied by the node and gives the bit timing.

However, the "fixed" capacity may be modified by the NTC; for example, in order to test at a slow timing rate the controller of a switch which no train is approaching, and to increase the timing when a train does approach ("imperative" control). The node can be perfectly well remote-controlled and can cause the bit clock timing it supplies to the connected unit to vary.

A variation in the locally-controlled static bit rate may even be contemplated. One application would relate to telephone access terminals made available to equipment operators (in principle, not to engineers, since stoppage of a locomotive above a beacon provides a high, continuous bit rate). The operator should plug in a piece of equipment containing the handset, the call keypad, and the appropriate conversion equipment (digital-analog with filtering, and vice-versa). In one variant, the plugged-in equipment would itself form the base for a wireless telephone allowing remote access in an area of one hundred meters. The transmission problem raised consists in supplying a link beginning only as of the moment when the equipment is plugged in, and, as the case arises, to supply a different bit rate during the call, communication-establishment, and conversation phases. A call button should be installed, which would cause the node to emit a request for bit rate, with the gate to which the terminal is connected.

4. As regards frame format, a format is suggested below, for the sole purpose of demonstrating the feasibility of the system and its degree of complexity. Choice is made of a frame length of 1,024 bytes. This choice results from a compromise between the desire to combine a sufficient number of data bytes (in this case, up to 955) to the overhead (here, 69 bytes) and the desire to ensure the efficacy of dynamic management of capacity by means of a high frame frequency (in this case, 320 frames/second, for a bit rate of 2,048 Mbits/second).

bytes 0–2: Frame numbering and Synchronization;

bytes 3–31: Dynamic Capacity Assignment;

bytes 32–36: Static Capacity Assignment;

bytes 37-n: Statically Multiplexed Data;

bytes n-991: Dynamically Multiplexed Data;

bytes 992–1023: Requests for Dynamic Capacity.

Frame Numbering and Synchronization (bytes 0–2)

Bytes 0 and 1 contain a synchronization pattern. Byte 2 contains a frame number. Only the last four bits are used to specify the frame within the multiframe; however, all of the eight bits allow distribution of a clock with a period of approximately one second. The frame number is used, on the one hand, to ensure sub-multiplexing making it possible to provide low bit rates at some gates, and, on the other, to coordinate the hand-overs.

Dynamic Capacity Assignment (bytes 3–31)

Each of the bytes 3 to 20 (byte 31 always contains 0) assigns to a given train a transmission capacity of 32 bytes in the Dynamically Multiplexed Data area of the frame. The train in question is designated by a shortened number, 1 byte long, which was preliminarily assigned to it by the Nodal Transmission Center (NTC). A single train can have assigned to it a multiple capacity of 32 bytes in the frame, which does not have to correspond to contiguous Dynamically Multiplexed Data areas. It may also have a number of areas which vary from one frame to another, but in a way agreed upon in advance as a function of the number of the frame within the multiframe. For a frame frequency of 250, each capacity increment of 32 bytes corresponds to a bit rate increment of 64,000 bits/second. The lowest bit rate that can be dynamically assigned is 32 bytes every 16 frames, or 4 kbits/s. The highest bit rate is 28×32 bytes per frame, or 1,792 Mbits/s. The address 0 is never assigned to a train, and its use in Dynamic Capacity Assignment thus makes it possible not to assign a memory area; however, it may be statically assigned. No distribution mechanism for all trains is provided. The reason for this absence lies in the difficulty, not of delivering the information to the nodes, but of supplying it to the trains by superposing it on the information normally delivered. It is possible, nevertheless, to envisage the broadcast of a warning using an additional interface wire. A more complex message must, in theory, be individually addressed to each train by the NTC.

Static Capacity Assignment (bytes 32–36)

This area makes possible the modification of the capacities assigned to semi-static multiplexing (Statically Multiplexed Data area). A single capacity may be modified by frame. The Static Capacity Assignment area is made up of three sub-areas:

the first, 12 bits long, designates a node. The nodes have a number fixed in EPROM. Two identical numbers must not occur un a managed line area, whether in normal or emergency mode, by a single NTC. The number 4095 is reserved for the reconfiguration mode;

the second area, 4 bits long, designates a node gate. Gates 14 and 15 are reserved for the reconfiguration mode;

the third area, 24 bits long, designates the assigned bytes. The first 14 bits designate a byte address in the frame (10 bits) and a frame number in a multiframe (4 bits). The next 9 bits constitute a mask which names that one of the last 9 bits in the preceding area not to be taken into account: the first five relate to the last 5 bits in the address area, and the last 4, to the frame number. Accordingly, a zero mask represents a capacity of 1 byte per multiframe, or, for a frame frequency of 250, a bit rate of 125 bits/second. A mask of 111 (binary) represents a capacity of a byte in one frame out of two, or a bit rate of 1 kbit/s; and a mask of 111111 represents a capacity of 4 bytes in each frame, or a bit rate of 8 kbits/s. A value of 0 in the address area deletes a preceding assignment.

It will be noted that the following variant would have been content with 16 bits used to indicate the bytes assigned, but it is handled less flexibly. The first 14 bits designate (with an accuracy which may be superfluous, as will be seen, a byte address within the frame (10 bits), followed by a frame number in the multiframe (4 bits). All of the zeros which terminate the area indicate how many of the low-weight bits among the first 14 are not to be taken into account. As an example, the value (as expressed in the binary system) 1100110011010111 assigns the address byte 1100110011 in the frame 0101, for a bit rate of 125 bits/s. The value 1100110011011100 assigns the same address in 1 frame out of 4, for a bit rate of 1 kbit/s. The value 1100110010000000 assigns the address bytes 1100110000 to 1100110111 in each frame, for a bit rate of 16 kbits/second.

In the frames not used by the NTC for modify static assignments, the 40 bits emitted by it are at 0. The null condition of the first 16 bits may be advantageously used by a node to request a static assignment at one of its dynamic gates, as indicated for the mechanism for assignment of a shortened number of a train not yet possessing said number, and indeed, to one of its static gates, in accordance with the possibility mentioned with regard to telephone connections. This node, which recognizes the null value of the first 16 bits, enters its own number and that of the gate involved in these first 16 bits. Of course, it is possible that several nodes may function in the same way during a single frame. The mechanism indicated shows that it is the last one to cross "which wins." Because a node will emit the same request, frame after frame, until it has obtained a shortened number for the gate in question, this collision exhibits no disadvantage other than that of delaying assignment.

Statically Multiplexed Data (bytes 37-n).

The Statically Multiplexed Data area is managed using static, or, more precisely, low-level dynamic multiplexing, whose assignment mechanism is indicated by the Static Capacity Assignment area. By means of adjusting the multiframes, the individual bit rates can be spaced out between 125 bits/s and 64 bits/s.

Dynamically Multiplexed Data (bytes n-991)

These include all of the 32 byte areas dynamically assigned to transmission with the trains according to the indications supplied by the Dynamic Capacity Assignment area. The boundary of separation n between the Statically Multiplexed Data area and the Dynamically Multiplexed Data area is controlled by the NTC, and is not known to the nodes (and does not have to be). The two areas may even overlap.

Requests for Dynamic Capacity (bytes 992–1023)

Each bit in this area corresponds to a train as specified by its shortened number. The NTC initially places all of this area at 0. Each node fed through can place at 1 certain bits, but not at 0; i.e., each nodes transmits downstream the logic merging of what it has received from upstream and of what it has added. It assigns to 1 the position corresponding to a train, one of whose gates bears the shortened number in its selection register, if, for that train, it has not been impossible for it to supply the bytes demanded by means of the Dynamic Capacity Assignment area. In other words, it assigns a 1 for a train which has supplied all of the bytes requested or to which no transmission capacity has been assigned. As regards a train one of whose gates contains the shortened number, it does not put down a 1 if there has been an underrun and, in particular, if no byte has been supplied. This latter case may apply to a train which is no longer covered (and it is through this mechanism that the NTC is so advised), or to a train covered continuously but which has just carried out hand-over. In this latter case, the NTC will not even be alerted. Nevertheless, it will receive a 1, but this 1 will have been added by the node to which the new beacon is connected.

5. As regards the architecture of a node, this architecture can be summarized as indicated below (FIG. 7):

1. External Interfaces

Static Interface

Input:

1 Data In (DI) wire,

1 Attention wire (A) (in the case of telephone access terminals)

Output:

1 Data Out (DO) wire

1 Clock Out (CO).

It should be emphasized that the binary bit rate can change. For example, if the gate corresponds to a switch controller, a control center may request, as a train approaches, a bit rate of 4 kbits/s, but have to settle, at other times, for a bit rate of 125 bits/s.

Dynamic Interface

Input:

8 Data In (DI) wires,

1 Attention (A) wire

Output:

8 Data Out (DO) wires,

1 Synchro Frame (SF) wire, 1 empty FIFO Output (EFO) wire.

It will be noted that the 8 Data In wires and 8 Data Out wires may be replaced by 8 two-directional Data wires and one directional-selection wire controlled by the connected apparatus. A parallel interface appears to be preferable to a series interface, both because the short distances between beacon and node make it possible (several meters), and because it appears advantageous to reduce the bit rate, since this rate may be high and the environment electrically polluted, and since the transmission mode must remain simple.

2. Internal Architecture

The architecture of the node may be broken down into a number of common devices which perform the following functions:

a) reconfiguration b) extraction-injection, c) time base, d) management of capacities, and which manage an address bus (AB) and a data bus (DB), this latter being a series bus and the following, connected to these buses:

dynamic management gates Pd, static management gates Ps.

a) Reconfiguration

As indicated above in the discussion concerning failure management, the node has 2 inputs EG and ED and two outputs SD and SG. It may function in 4 modes according to the position it occupies in the loop under consideration.

The reconfiguration apparatus performing the functions described above comprises solely the electronic relays which provide for the contacts corresponding to the four modes. It is the time base TB which must seek synchronization; send the command ordering alternate switching between modes 1 and 4 (and providing for a period of two alternations equalling the duration of approximately 4 frames) for as long as it has not found synchronization; inhibit any transmission other than a repetition for as long as it recognizes the code 0FFFF (hexadecimal) in the Static Capacity Assignment area; and recognize a potential order to go into mode 2 or 3.

One potential technological problem should be indicated during resynchronization. It will happen that two adjoining beacons both try to "drive" the link between them.

b) Extraction-Injection

The overall performance levels of the loop are partially linked to the time required to pass through each node. It appears impossible to go below a bit time, but this time should not be exceeded, and, in particular, a byte-time should not be added.

Despite the switch-over from an HDB3 mode to a pure binary mode, and vice-versa, it must be possible to repeat with a delay of 1 bit time. This is, in particular, necessary to generate the appropriate parity violations. The bit intended to replace, as needed, a received bit must be available at the same time as this bit. In practice, this means that there must be an 8-bit register which loads itself continuously with bits received from upstream and sometimes recopied on a bus, and an 8-bit register which can be cleared in series over the downstream link and which is loaded at the latest when the first of its bits is needed. An injection sweep circuit must select the series input or the downstream series output of the entry register. These registers may be distributed and duplicated in the gates, if the decision is made to use a series bus for data transfer. All of these functions are brought together in FIG. 7, under the reference E/I.

It is doubtless timely to indicate the reaction times to expect. If the distance from NTC1 to NTC 2 is 200 kilometers and if the propagation speed in the cable is 200,000 km/second, if there is a node every 200 meters (and thus, in extreme cases of reconfiguration, each of 1000 nodes is fed through twice), and if the feed-through time is 1 bit-time, then the total time for travel around the loop is 3 ms, or a little less than a frame period. If the NTC has infinite processing power, i.e., if it is capable of taking into account the fact that, in a frame, this frame is transmitting requests for capacity which it has received in the preceding frame, 4 frame periods pass between the moment when the train requests a transmission capacity and the moment when it obtains said capacity. To take into account the processing times, it is more reasonable to count on 5 frame periods or 20 ms. This duration corresponds to distance covered of 2 meters for a TGV train travelling at 360 km/hour, and 1 meter for a locomotive travelling at 180 km/hour. Accordingly, it does not assign in excessive fashion the transmission capacity of a train which does not have continuous coverage. It can be seen that the stakes involved in having a feed-through time of 1 bit time rather than 1 byte time is approximately 4 ms. Thus, despite everything, it would thus be acceptable to "take one's time." Let us add that, in the case of a locomotive having available only one byte per multiframe, the request is emitted beginning with the first frame, but the capacity-waiting time may be extended by 15 frames or 60 ms; or again, 3 meters for a locomotive travelling at 180 km/hour. The advantage of equipping the ultrahigh frequency reader with an extended-coverage antenna, a loss cable, or slotted waveguide will be understood.

c) Time Base

The time base TB has multiple functions:

It recognizes the bit timing based on upstream reception and, in the absence of reception, synthesizes an approximately equal timing;

It creates the frame timing;

It looks for the synchronization pattern, while awaiting its end in normal time in the second or third byte of what it expects to be the new frame. If the pattern is not found in more than n consecutive frames, it switches over to the resynchronization mode, where it looks for the pattern everywhere;

It reads the frame number following the synchronization pattern;

It multiplexes, on a parallel address bus AB, the frame and bit number (17 wires) and the shortened train number (8 bits) supplied by the dynamic management FIFO, an eighteenth wire providing for multiplexing between the two pieces of information (or else, in a first phase, the bit number (13 bits) and, in a second phase, the frame number (4 bits) and the shortened frame number (8 bits), thereby limiting to 14 the number of wires in the bus);

It recognizes orders concerning a series gate in bytes 32–33 and send to the appropriate gate a selection signal at the end of byte 36, so that this gate will record the information delivered over the series data bus DB;

It supplies a validation datum to the parallel gates during frames 992–1023, so that, if these gates have recognized the shortened number of their train in the 8 low-weight bits of the address bus AB, they will add a 1 to the series entry bus if they have not registered an underrun when they were requested to supply data bytes;

It sends an entry pulse to the dynamic management FIFO DMF during bytes 0 to 31 and delivers to it a byte 0 over the data bus during bytes 0, 1, 2, and 31; it sends to this FIFO a read pulse every 32 bytes and gives it control over 8 address bus (AB wires in every second phase of the presentation of addresses to this bus.

d) Management of Capacities and Gates

The management of dynamic capacities goes through the entry and read-out of the dynamic management FIFO. This FIFO is loaded beginning with bytes 0 to 31 belonging to the frame (bytes 0–2 and 31 correspond to stuffing). Each non-null byte represents the shortened number of a train authorized to use the group of 32 bytes corresponding to its position in the FIFO, in order to receive and transmit data. Consequently, each byte of the FIFO is delivered, during 32 successive byte times, to the address bus AB, where it is multiplexed with the bit time and the frame number. The dynamic management gates compare, at $C_1$ and NA, the shortened train number as delivered to the one entered in their assignment register. In the event of agreement, at each byte time, they read a byte in the input FIFO $F_1E$ and enter a byte into the output FIFO $F_1S$. Attention: the reading of a byte must take place before it is injected into the line, and the entry of a byte can take place only after it has been received. Because the node feed-through time is equal to only 1 byte time, all entries must take place in one bit time before the readings of the same address. One solution consists in having the gate Pd recopy all of the byte times and record the fact that it has read a byte, and enter a new byte only when it has read a byte earlier. It is doubtless desirable that data transfer occur in series over a wire bit by bit, rather than in parallel byte by byte.

The issue of static capacities and of timings managed by RS is achieved by comparison at $C_2$ of the byte time (and frame number) delivered to the addresses bus (AB) with what the gate has stored as control data, i.e., the same type of information, plus a mask which explains the bits not to be taken into account for comparison purposes. This control information has been delivered in series and stored in parallel in a 24-bit register. Data transfers could also be effected in series. The gate Ps also incorporates a selector making it possible to select that one of the wires of the addresses bus AB to be used to impart timing to the external series link, which is an even timing even if the data arrive in bursts.

The preceding description of the architecture of a node makes use only of hard wired logical elements. The implementation of certain functions could obviously include the use of a microcontroller and the suitable software.

I claim:

1. A short-range bidirectional transmission system comprising a ground-based network including a plurality of beacons disposed successively along a path on the ground, each beacon having a maximum coverage length, and a moving object having an antenna and being operative to move along said path, wherein said antenna installed on the moving object has a coverage area substantially longer in the longitudinal dimension of the moving object (i) than in the transverse direction and (ii) than said maximum coverage length of each of said beacons.

2. A short-range transmission system according to claim 1, wherein the distance between adjoining beacons is within a range that is between a dimension that is slightly less than the length of the area measured along said path that is covered by the antenna of the moving object, and a dimension that is slightly greater-than said length.

3. A short-range transmission system according to claim 1, wherein the antenna carried by the moving object is a radiating cable.

4. A short-range transmission system according to claim 1, wherein the antenna carried by the moving object is a slotted waveguide.

5. A short-range transmission system according to claim 4, in which the moving object comprises a plurality of series-connected vehicles, each of said vehicles supporting a waveguide serving as an antenna, wherein the waveguides of two adjacent vehicles are connected by a flexible waveguide.

6. A short-range transmission system according to claim 4, in which the moving object comprises a plurality of series-connected vehicles, each of said vehicles supporting a waveguide serving as an antenna, wherein the waveguides of two adjacent vehicles are operatively connected by a coaxial cable to which they are adapted.

7. A short-range transmission system according to claim 4, in which the moving object comprises a plurality of series-connected vehicles, each of said vehicles supporting a waveguide serving as an antenna, wherein, when the vehicles are aligned, the waveguides of two adjacent vehicles are aligned and separated by a short distance one from the other, so as to allow coupling by radiation.

8. A short-range transmission system according to claim 1, wherein the antenna is formed by two slotted waveguides such that the coverage area of one includes one portion which, in the longitudinal direction, does not belong to the coverage area of the other.

9. A short-range transmission system according to claim 1, comprising a Nodal Transmission Center (NTC), a plurality of nodes ($N_i$, $N_j$) and a ring link wherein said ring link connects together said Nodal Transmission Center (NTC) and said nodes ($N_i$, $N_j$), said beacons being connected to at least some of said nodes and being arranged in succession along said path.

10. A short-range transmission system according to claim 9, wherein said plurality of nodes is divided in two groups, each group forming a respective ring connected to a corresponding Nodal Transmission Center for management of beacons connected to nodes in each said group; wherein said system further comprises means for configuring said two groups forming said two rings in a topological continuity.

11. A short-range transmission system according to claim 10, wherein said system is operative according to a protocal wherein:

a. any node ($N_j$) in a ring having lost synchronization on a long-term basis looks, in alternating fashion, for a message structure on an input issuing from first one of adjoining nodes (Ni) on one side of said ring, and then from the other adjoining node (Nk) on the other side of said ring;

b. while a node (Nj) carries out a search to one side of said ring, said node Nj retransmits on the other side of said ring information that said node Nj has received;

c. said Nodal Transmission Center transmits said message during a time sufficient for locking on nodes gradually;

d. said Nodal Transmission Center addresses a reloop order to a specified node (Nm) which said Nodal Transmission Center wishes to make a last node of the loop.

12. A short-range transmission system according to claim 9, wherein said system transmits information that is structured in frames and wherein one part of said information describes an addressee to which a portion of the frame is assigned and wherein another portion of the frame is permanently or semi-permanently assigned.

13. A short-range transmission system according to claim 12, wherein said moving objects are trains and wherein each of said trains, beacons, and nodes comprise means for ensuring that, by means of the beacons with which they are in contact, said trains indicate to the node which is connected to said beacons addressing information for allowing the node to extract from said frame the information sent from said train.

* * * * *